US007124475B2

(12) United States Patent
Jeffries

(10) Patent No.: US 7,124,475 B2
(45) Date of Patent: Oct. 24, 2006

(54) D-RING HANDLE

(75) Inventor: Mark Jeffries, Cumming, GA (US)

(73) Assignee: Austin Hardware & Supply, Inc., Lee's Summit, MO (US)

( * ) Notice: Subject to any disclaimer, the term of this patent is extended or adjusted under 35 U.S.C. 154(b) by 0 days.

(21) Appl. No.: 10/063,187

(22) Filed: Mar. 28, 2002

(65) Prior Publication Data

US 2003/0182763 A1 Oct. 2, 2003

(51) Int. Cl.
*E05B 1/00* (2006.01)

(52) U.S. Cl. ..... 16/445; 292/336.3

(58) Field of Classification Search ..... 16/445, 16/444, 446, 419, 420, 408, 409, 430; 292/336.3
See application file for complete search history.

(56) References Cited

U.S. PATENT DOCUMENTS

| | | | | |
|---|---|---|---|---|
| 258,009 | A | 5/1882 | Blackham | |
| 337,889 | A | 3/1886 | Taylor | |
| 1,705,071 | A | 3/1929 | Sheehan | |
| D119,418 | S * | 3/1940 | Anderson et al. | D8/306 |
| 2,402,348 | A | 6/1946 | Schroeder | |
| 2,540,686 | A | 2/1951 | Milburn | |
| 2,638,370 | A | 5/1953 | Price | |
| 2,666,319 | A | 1/1954 | Price | |
| 2,715,243 | A | 8/1955 | Koll | |
| 2,919,569 | A | 1/1960 | Davis | |
| 2,923,145 | A | 2/1960 | LaBrie | |
| 3,681,807 | A * | 8/1972 | Ciepley | 16/419 |
| 3,831,532 | A | 8/1974 | Smith et al. | |
| 3,871,198 | A | 3/1975 | Miller | |
| 4,009,506 | A * | 3/1977 | Henriksen | 16/419 |
| 4,242,022 | A | 12/1980 | Fredrickson | |
| 4,336,631 | A | 6/1982 | Duff et al. | |
| D316,365 | S | 4/1991 | Hansen et al. | |
| D316,366 | S | 4/1991 | Hansen et al. | |
| D317,398 | S | 6/1991 | Hansen et al. | |
| D318,007 | S | 7/1991 | Hansen et al. | |
| 5,042,676 | A * | 8/1991 | Gohlke | 220/759 |
| 5,052,869 | A | 10/1991 | Hansen | |
| D323,776 | S | 2/1992 | Hansen | |
| D323,970 | S * | 2/1992 | Schlack | D8/341 |
| 5,339,487 | A * | 8/1994 | Kasper | 15/246.2 |
| 5,450,735 | A * | 9/1995 | Esaki et al. | 70/208 |
| 5,493,881 | A * | 2/1996 | Harvey | 70/277 |
| D389,393 | S | 1/1998 | Hansen | |
| D390,770 | S * | 2/1998 | Burnley | D8/331 |
| D393,197 | S * | 4/1998 | Burnley | D8/331 |
| 5,794,994 | A * | 8/1998 | Miyagawa et al. | 292/336.3 |
| 6,065,917 | A * | 5/2000 | Shambeau et al. | 410/107 |
| D429,141 | S * | 8/2000 | Antonucci et al. | D8/331 |

(Continued)

OTHER PUBLICATIONS

U.S. Trademark Registration No. 2,275,109, Registered Sep. 7, 1999, Hansen Manufacturing Company, for Vehicle Handle Assembly for Doors of Emergency Vehicles and Fire Trucks.

(Continued)

*Primary Examiner*—Robert J. Sandy
*Assistant Examiner*—Andre' L. Jackson
(74) *Attorney, Agent, or Firm*—Polsinelli Shalton Welte Suelthaus PC

(57) ABSTRACT

The present invention relates to a handle member having a tab which, when pushed, allows the handle to be hingedly rotated from a resting position to a position substantially perpendicular to a faceplate member. In particular, the present invention relates to a D-ring handle having a tab, whereby the D-ring handle is hingedly connected to a faceplate member.

16 Claims, 7 Drawing Sheets

U.S. PATENT DOCUMENTS

| | | | | |
|---|---|---|---|---|
| D442,844 | S * | 5/2001 | Mirick | D8/301 |
| 6,389,645 | B1 | 5/2002 | Polidoro | |
| 6,397,436 | B1 | 6/2002 | Wang | |
| 6,412,425 | B1 * | 7/2002 | Chen | 108/44 |
| 6,421,882 | B1 | 7/2002 | Liao et al. | |
| 6,467,130 | B1 | 10/2002 | Kurachi et al. | |
| 6,502,871 | B1 * | 1/2003 | Malmanger | 292/204 |
| D469,678 | S * | 2/2003 | Teskey | D8/301 |
| 6,616,222 | B1 | 9/2003 | Ponceau | |

OTHER PUBLICATIONS

U.S. Trademark Registration No. 2,248,451, Registered Jun. 1, 1999, Hansen Manufacturing Company, for Vehicle Handle Assembly for Doors of Trucks, Utility Vehicles, and Rescue Vehicles.

* cited by examiner

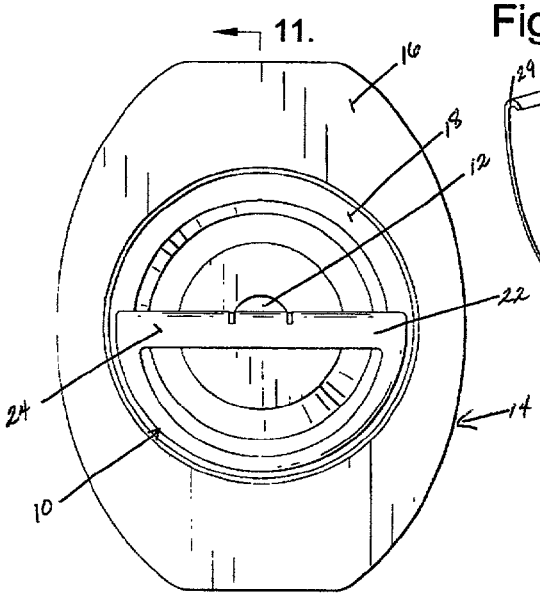
Fig. 7.
Fig. 8.
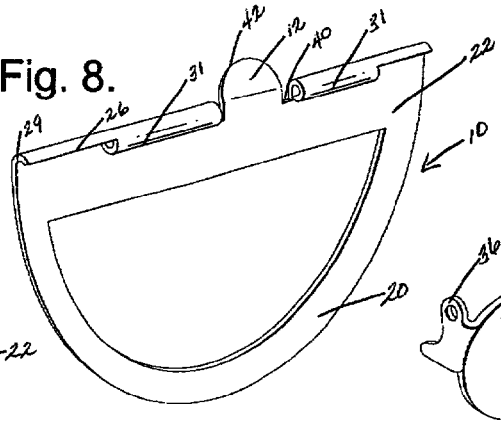
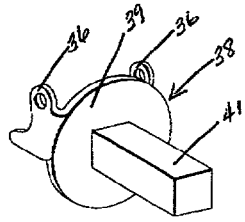
Fig. 10.
Fig. 9.
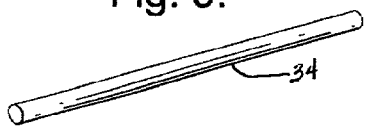

D-RING HANDLE

FIELD OF INVENTION

The present invention relates to a handle, preferably a D-ring handle, having a tab. The tab can be pushed to hingedly rotate the handle from a storage position, where the handle is in contact with a housing member, to a position where the handle can be turned to actuate a latch, or similar mechanism.

BACKGROUND OF INVENTION

D-ring handles, or handles of a similar construction, are often used in association with emergency vehicles, such as fire trucks and ambulances. The handles are located on doors and cabinet faces so that when a handle is lifted and turned, the door, or similar member is unlatched, and it can be opened. The D-ring construction is preferred for use with such vehicles because the D-ring can be turned or rotated more easily by a person wearing a glove, such as a fireman. A gloved hand can easily grab the D-ring to rotate it.

The D-ring typically is located within a housing member, which has an outer flange and a recessed faceplate. The D-ring will rest against the recessed faceplate member, which makes it difficult for a person, especially one who is wearing a glove, to slip their fingers behind the D-ring. Difficulty in slipping fingers behind the D-ring makes it difficult to hingedly rotate the D-ring so it is substantially perpendicular to the faceplate. As mentioned, once the D-ring is in a substantially perpendicular position, it can be rotated in a circular or semi-circular path to unlatch a door.

For the above reasons, it has been known to form a D-ring, whereby the curved leg portion of the D-ring is angled outward. This creates a larger space between the D-ring handle and the faceplate. A person wearing gloves can then more easily slip a finger behind the curved leg portion of the D-ring to hingedly rotate it outward to a substantially perpendicular position and then turn the handle.

The curved leg of the D-ring, which angles outward, is suitable for use; however, even with the curved leg, it often remains difficult for a person to slip a gloved finger behind the D-ring, making it difficult to hingedly rotate the D-ring to a position substantially perpendicular to the faceplate. In addition, it is advantageous to allow the leg to remain flush, or in contact, with the faceplate when not in use. For these reasons, it is desired to have a D-ring handle that can be easily gripped, rotated outward, and turned by a person wearing gloves, but which remains flush, or in contact, with the faceplate when not in use. It is especially desired to have a D-ring that can be easily moved to a substantially perpendicular position, without the necessity of slipping a finger behind the leg to pry it away from the faceplate.

SUMMARY OF INVENTION

The present invention relates to a handle member having a tab. Preferably, the handle is a D-ring member having a leg and a base. The handle member is hingedly connected to a faceplate member and can be moved to actuate a latch. Preferably, the handle is turned in a circular, or semi-circular direction. When not in use, the handle will be in a resting position, whereby it is in contact with, and substantially coplanar to, the faceplate. Upon pushing the tab, the handle is hingedly rotated from the resting position to a position substantially perpendicular to the faceplate. This allows the handle to then be turned in a circular, or semi-circular path to actuate a latch or similar member.

The present invention is advantageous over other D-ring handles, because it has a tab that can be pushed to easily move the handle from a resting position to a position, whereby the handle can be actuated. The present invention is also advantageous because the leg of the handle or D-ring handle does not have to have a curved outward construction. Instead, it can be placed in a resting position that is flat against the faceplate.

BRIEF DESCRIPTION OF DRAWINGS

FIG. 7 is a front perspective view of an alternative embodiment of the D-ring handle attached to a faceplate;

FIG. 8 is a side perspective view of the D-ring handle, shown in FIG. 7, having a pair of tubes;

FIG. 9 is a side perspective view of the pin, which rotatably attaches the D-ring handle to the foot member;

FIG. 10 is a side perspective view of the foot member on which the D-ring of FIG. 7 will rotate;

DETAILED DESCRIPTION

Figure 1:
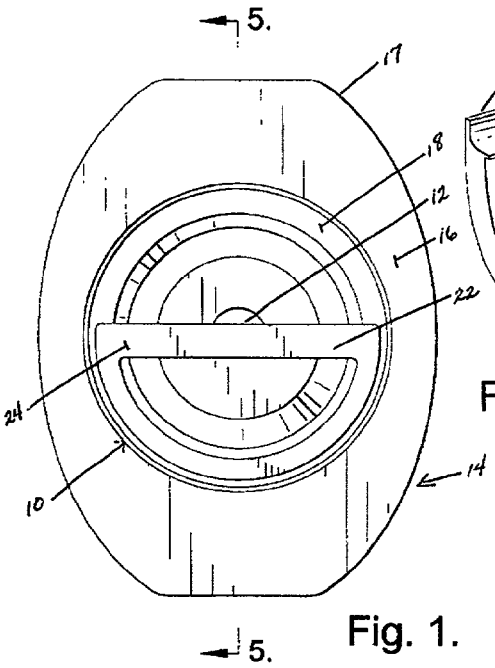
FIG. 1 is a front perspective view of the D-ring handle attached to a faceplate.

The present invention relates to a handle member well-suited for use with emergency vehicles. The handle will rotate hingedly, and can be turned to actuate a latch, or similar member. Preferably, the handle is a D-ring handle 10 mounted in a housing, shown in FIGS. 1, 7, 13, and 19. The D-ring handle 10 and housing or substrate 14 is well-suited for use with emergency vehicles, such as fire trucks and ambulances. Included in the D-ring handle 10 construction is at least one tab member 12. The D-ring 10 is rotatably attached to the substrate member 14.

The faceplate, or substrate 14, will fit into a cut out found in a door or similar member. Preferably, the substrate member 14 is a faceplate having a flange 16 and a recessed face member 18. The faceplate has an outer edge 17 that is of any of a variety of shapes and dimensions. The D-ring 10 can be rotated in a circular, or semicircular path to actuate the movement of a latch or similar member so that a door can be unlatched and opened. As would be expected, the D-ring 10 does not have to rotate in a circular, or semi-circular path. Instead, it could move in any direction or path which allows the latch to be actuated.

Figure 2:
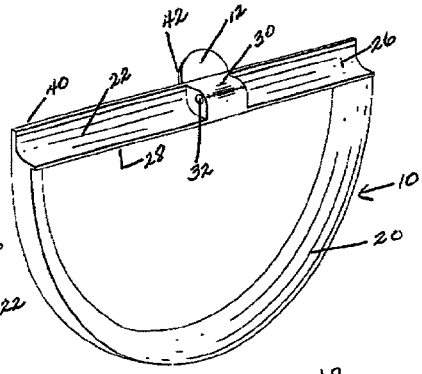
FIG. 2 is a side perspective view of the D-ring handle having a block member.
Figure 3:
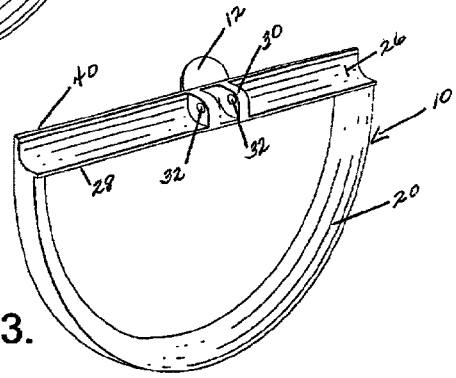
FIG. 3 is a side perspective view of the D-ring handle having a cut out block member.
Figure 14:
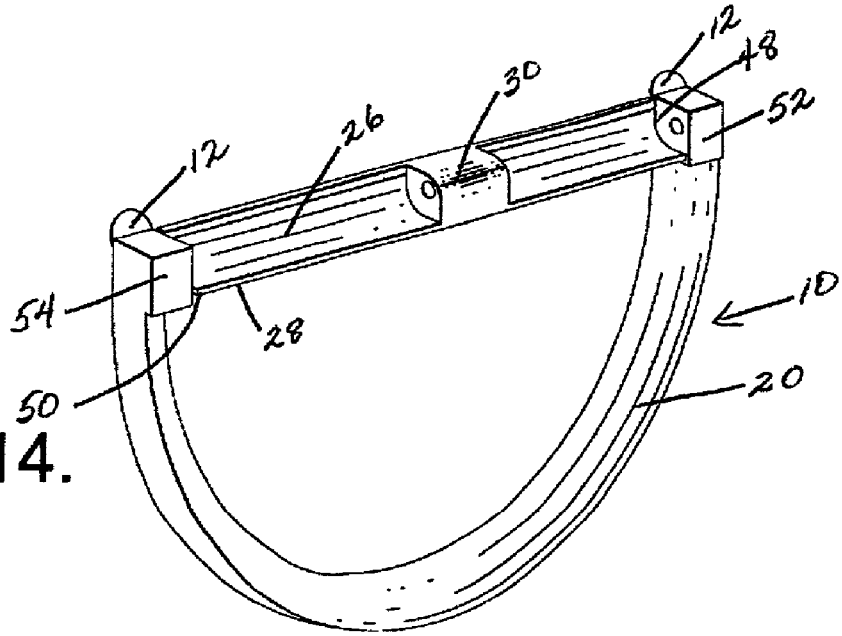
FIG. 14 is a side perspective view of the D-ring handle, shown in FIG. 13.
Figure 15:
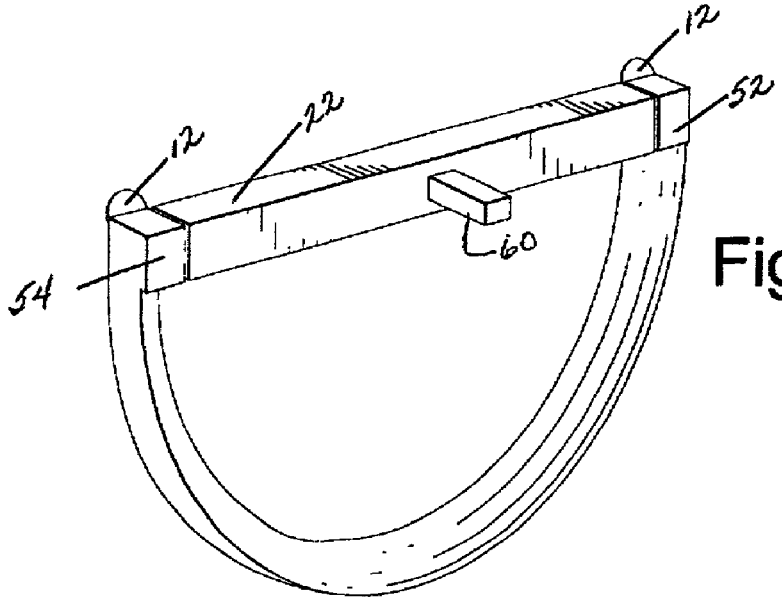
FIG. 15 is a side perspective view of an alternate embodiment of the D-ring handle shown in FIG. 13.
Figure 16:
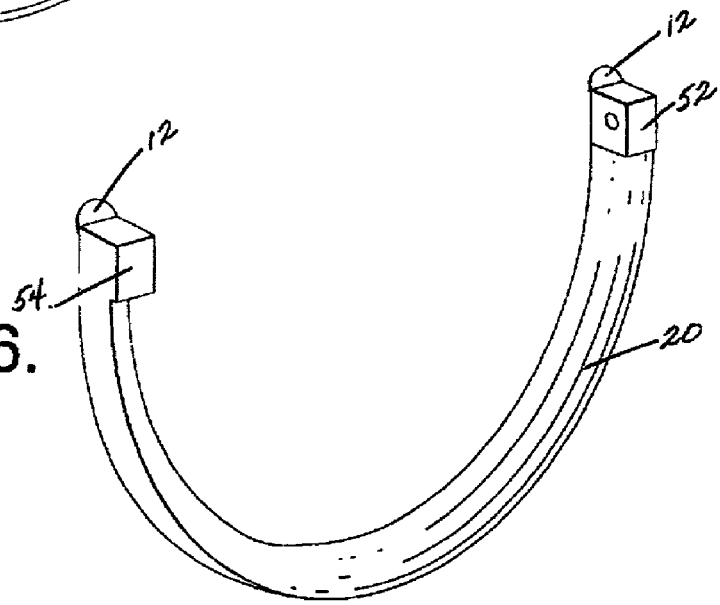
FIG. 16 is a side perspective view of the curved leg of the D-ring handle shown in FIG. 13.

The D-ring handle 10 is formed from a D-shaped ring member having a curved leg 20 and a base 22, shown in FIGS. 2 and 3. The leg 20 and the base 22 can be integrally attached to one another to form a unitary construction, shown in FIGS. 2, 3, and 8. Alternatively, the curved leg 20 can be hingedly attached to the base member 22 so that the base member remains stationary when the curved leg is moved relative thereto, as shown in FIGS. 14 and 15. Preferably, the leg is hingedly rotated to a position substantially perpendicular to the base and faceplate. The dimensions of the curved leg 20 are such that it rests substantially flush within the recessed portion 18 of the faceplate 14. An alternative embodiment relates to the leg 20. While the curved leg is preferred, other shapes may be used. As long as the handle rests substantially coplanar to the recessed portion 18, any shape may be used. The handle can have a triangular, square, or T-shape, in the alternative. The handle can be biased to the closed position by use of a spring or similar device.

The base member 22 has a front face 24, shown in FIG. 1, and a back member 26, which are integral with one another. Generally, the base member 22 has a rectangular construction on its front face 24; however, a diamond shape, curved oblong shape, or other configuration can be used for the front face. The back member 26 can have an L-shaped construction, shown in FIG. 2, so that a ledge 28 is created on the back of the base member. The L-shaped construction of the back member increases the surface area to which the ends of the curved legs attach, thereby creating a stronger D-ring handle 10. The L-shaped construction places the ledge 28 in contact with the recessed portion 18 of the faceplate 14 when the D-ring handle is in its resting position, shown in FIGS. 1 and 5. Also, the L-shaped construction allows for easier attachment when connecting the handle 10 to the substrate 14.

Figure 4:
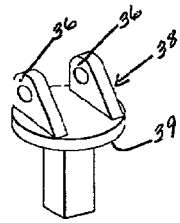
FIG. 4 is a side perspective of the foot member on which the D-ring of FIGS. 2 and 3 will rotate.
Figure 5:
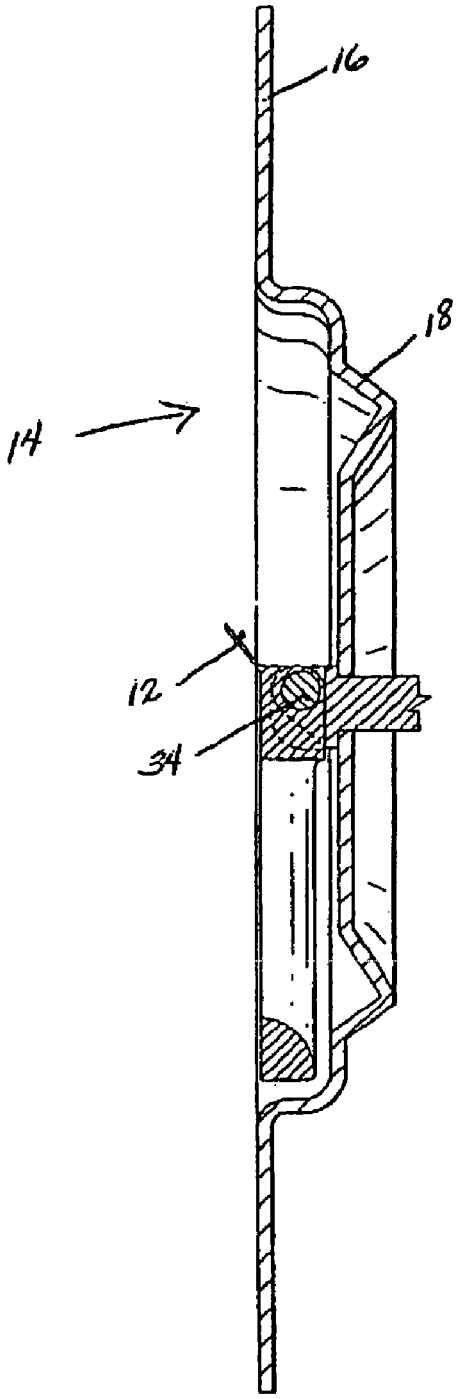
FIG. 5 is a side cutaway view of the D-ring handle, shown in FIG. 1, having a block member attached to the faceplate.
Figure 6:
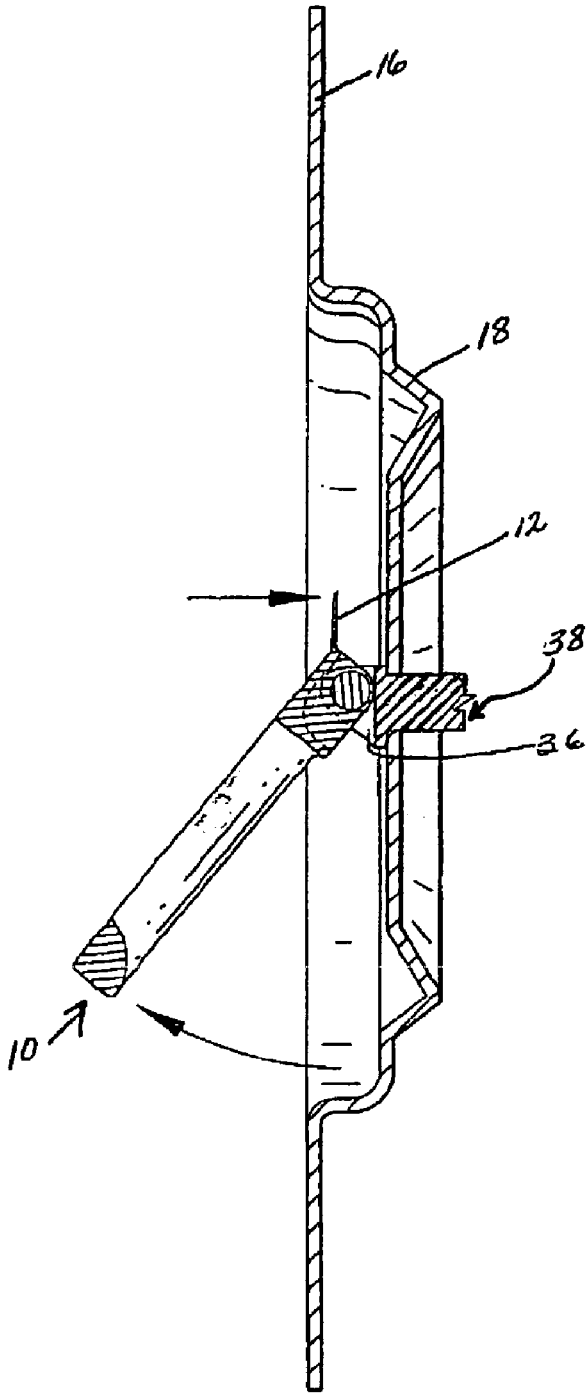
FIG. 6 is a side cutaway view showing the D-ring handle, shown in FIG. 1, having a block member, pivotally rotating on the faceplate.

The D-shaped ring member 10 is hingedly, and rotatably, connected to the substrate member 14 as shown in FIGS. 5 and 6. Any of a variety of means for forming a hinged connection with the substrate 14 can be used. An actual hinged connection does not have to be formed with the substrate, instead, the D-ring can be hingedly moved relative to the substrate 14. In one embodiment, a block member 30 is integrally attached to the ledge of the L-shaped construction, shown in FIG. 2. The block member 30 will have a hole 32 that passes therethrough. A pin 34, shown in FIG. 9, is received and rotatably held by the hole of the block member, with the pin rotatably attached on opposite ends to a pair of opposed protrusions, or flanges 36. The protrusions 36 are attached to the base 39 of a foot member 38, shown in FIG. 4, which rotates relative to the substrate member 14 to actuate the latch member. The foot member is rotated either in a circular or semi-circular path. Thus, the block member 30 and protrusions 36 form a hinged connection, shown in FIGS. 5 and 6. The block member does not have to be solid. It can be cut out in the middle, as shown in FIG. 3. Alternatively, an actual hinged member can be used instead of the block member 30. Other block constructions may be used, as long as the D-ring handle 10 can be hingedly connected to the substrate member 14 and can be rotated to actuate the latching mechanism.

Figure 11:
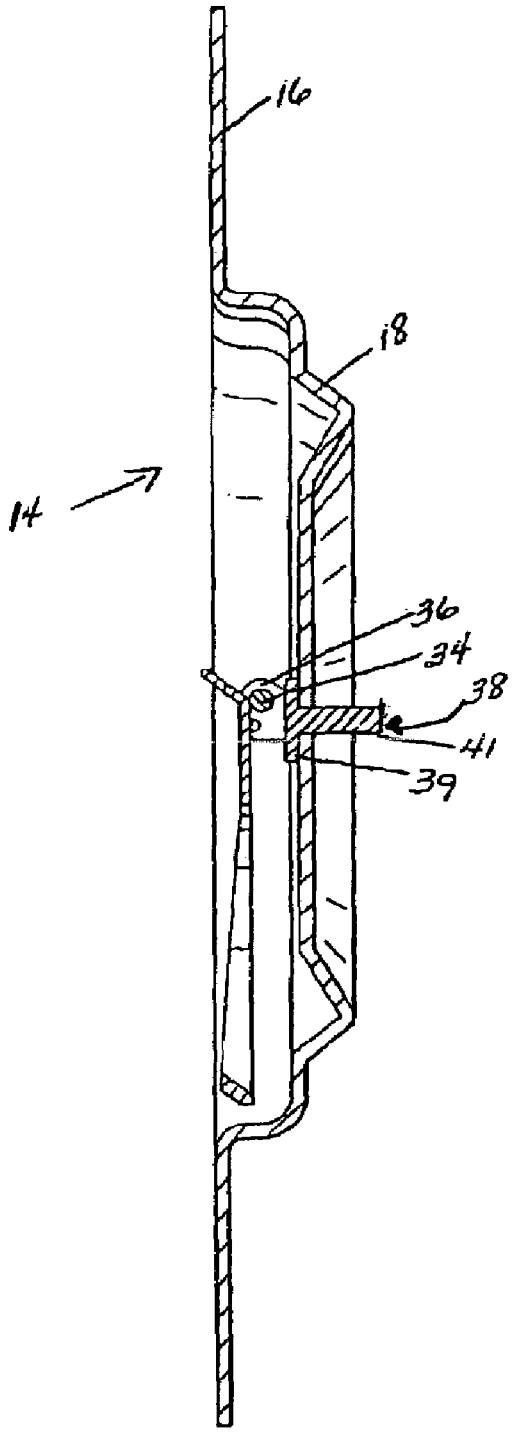
FIG. 11 is a side cutaway view of the D-ring handle, shown in FIG. 7.
Figure 12:
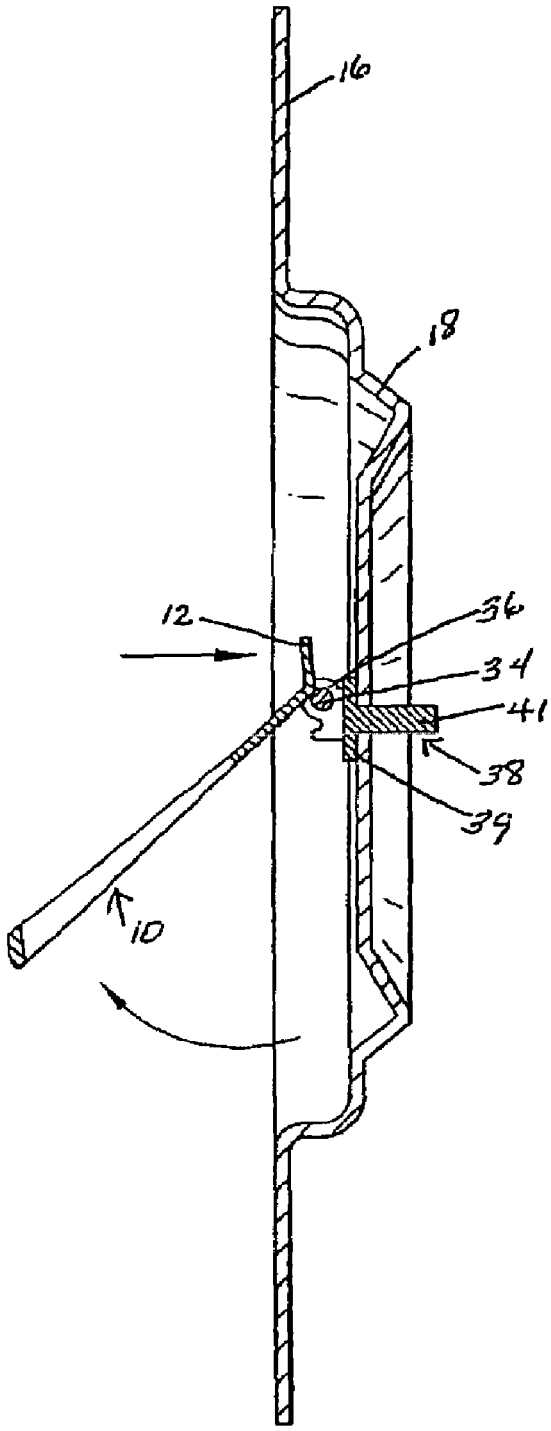
FIG. 12 is a side cutaway view of the D-ring handle, shown in FIG. 7, showing one tube pivotably rotating on the faceplate.

An alternative embodiment of the invention, shown in FIG. 7, includes two or more tube members 31 attached to the base member 26. The base member has aJ-shaped construction, shown in FIG. 8, so that a curve 29 is created on the back of the base member. The two or more tube members are integrally attached to the curve 29 of the base member 26. A pin 34, shown in FIG. 9, is received and rotatably held by the tube members, with the pin rotatably attached to a pair of opposed protrusions, or flanges 36. The opposed protrusions are attached to a foot member 38, shown in FIG. 10. The opposed protrusions are integrally attached to one side of a base 39 at one end of the foot member. The base can be any of a variety of shapes which allow the opposed protrusions to be attached to it. The base can be circular, rectangular, square, triangular, etc. A rectangular rod 41 is integrally attached to the side of the base opposite the protrusions. The foot member rotates relative to the substrate member so that the rectangular rod actuates the latch member, as shown in FIGS. 11 and 12. The foot member is rotated either in a circular or semi-circular path. Thus, the tube members 31 and protrusions 36 form a hinged connection.

Figure 13:
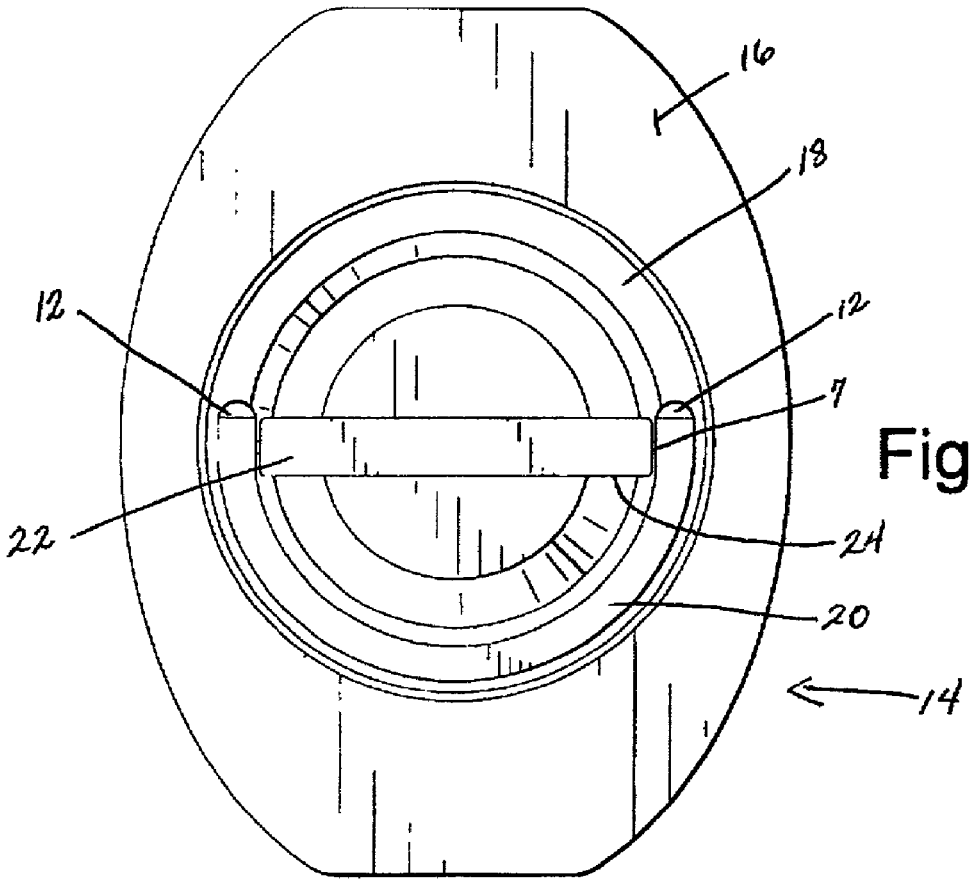
FIG. 13 is a front perspective view of an alternative embodiment of the D-ring handle attached to a faceplate.
Figure 17:
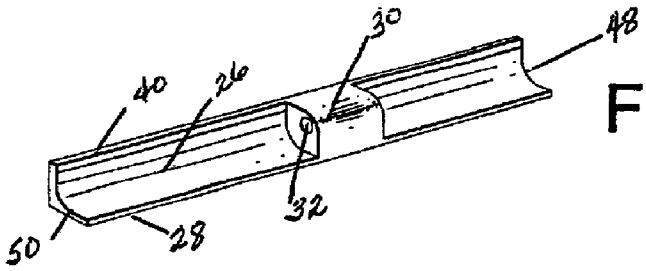
FIG. 17 is a side perspective view of the base member of FIG. 14.
Figure 18:
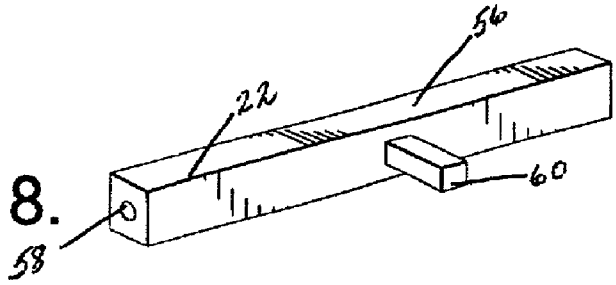
FIG. 18 is a side perspective view of the base member of FIG. 15.
Figure 19:
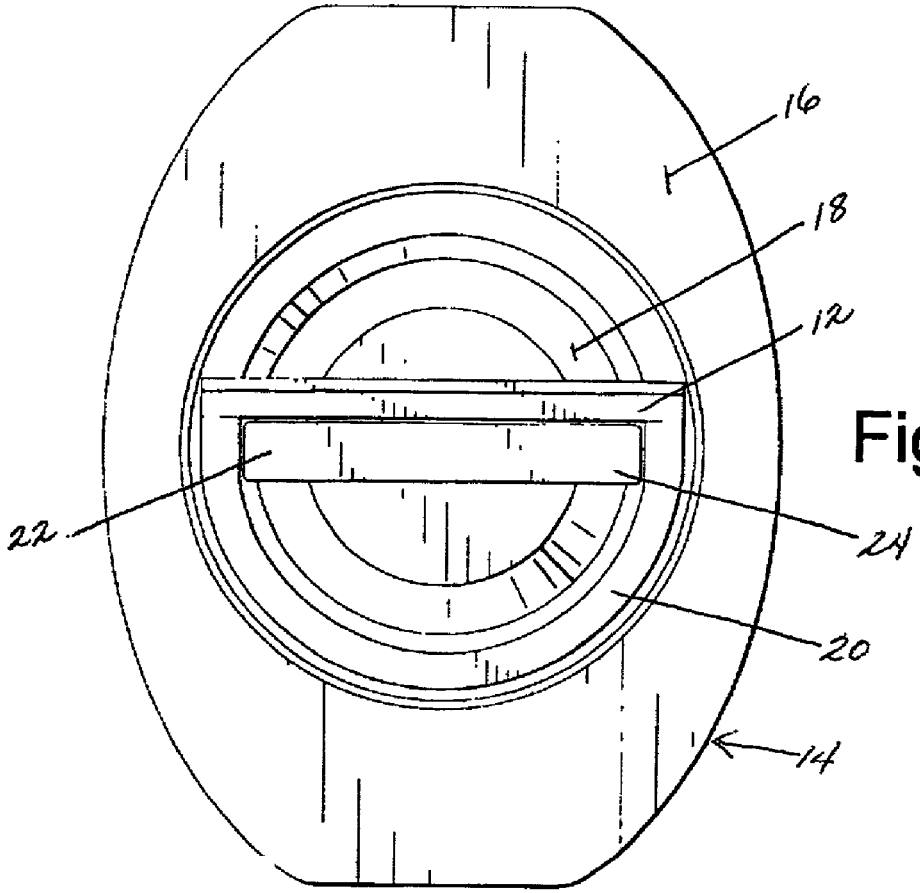
FIG. 19 is a front perspective view of an alternative embodiment of the D-ring handle attached to a faceplate.
Figure 20:
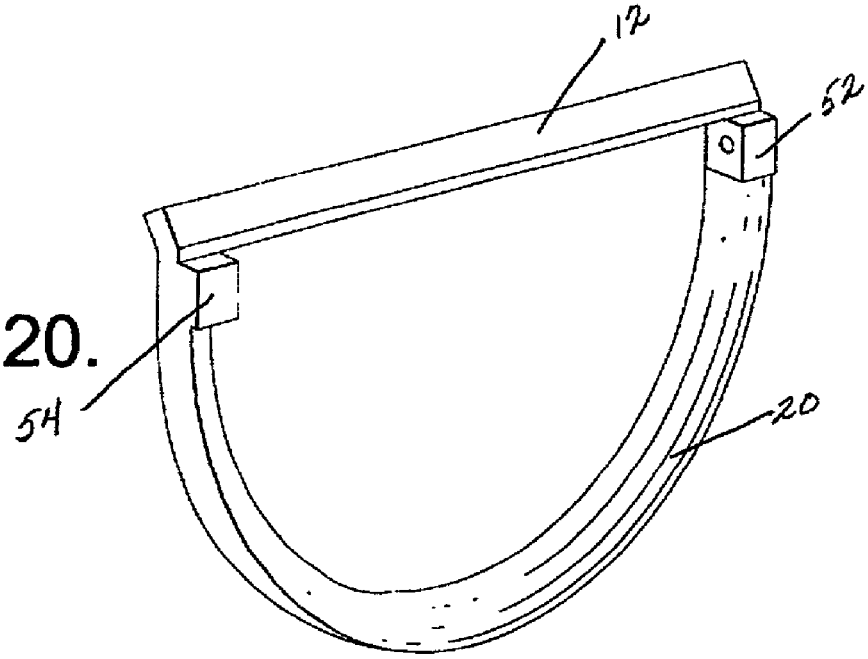
FIG. 20 is a side perspective view of the curved leg of the D-ring handle shown in FIG. 19.

If the D-ring 10 does not have an integral construction and, instead, the curved leg 20 is hingedly affixed to the base member 22, the pin 34, shown in FIG. 9, can be used to hingedly attach each end 52 and 54 of the leg 20 to each end 48 and 50 of the base 22, as shown in FIGS. 13—5 and 19. In this embodiment, the base member 22 will include ends 48 and 50, shown in FIG. 17, which are hingedly attached to the ends 52 and 54 of the curved leg 20, shown in FIGS. 14 and 15. The base member could be a rectangular shaped rod 56 having a hole 58 through its entire length for the pin 34 to pass through and a foot member 60 integrally attached at the middle of the rod 56, as shown in FIGS. 15 and 18.

In a further embodiment in which the curved leg is hingedly affixed to the base member, the base member is a rectangular shaped rod having a pin integrally attached to each end of the rod. The pins of the rectangular rod are inserted in the holes at each end of the curved leg to hingedly attach the rectangular rod to the curved leg.

The tab member 12 is integrally attached to the top edge 40 of the base 22, shown in FIGS. 1–3, 5–8, 11, and 12. A tab can also be attached to each end of the leg, shown in FIGS. 13–16. The tab can be integrally attached to each end 52 and 54 of the curved leg 20, above the base member 22, shown in FIGS. 19 and 20. The tab is pushed by a user of the D-ring, to pivot and move the leg of the D-ring away from the faceplate, to a substantially perpendicular position, as shown in FIGS. 6 and 12. When the tab 12 is pushed, the D-ring will hingedly rotate, whereby a user can easily grab the handle 10. The tab can be any of a variety of lengths and widths, and more than one tab may be used. Preferably, the tab 12 will project away from the top edge at an angle of about 45°, as shown in FIGS. 5, 6, 8, 11, 12, and 20. Other angles, however, can be used, as long as the D-ring can be rotated about 90°. The tab 12 is, preferably, integrally attached to the top edge 40 of either the base or the curved leg. The tab can have any of a variety of constructions. Preferably, the outer edge 42 of the tab 12 is a semi-circular shape. The edge 42 can have other shapes, such as triangular, U-shape, T-shape, square shape, or rectangular.

Preferably, the D-ring handle is made from metal, such as stainless steel; however, other types of metals or solid materials can be used, such as aluminum, zinc, or plastic.

Thus, there has been shown and described a D-ring handle, which fulfills all the objects and advantages sought therefor. It is apparent to those skilled in the art, however, that many changes, variations, modifications, and other uses and applications for the D-ring handle are possible, and also such changes, variations, modifications, and other uses and applications, which do not depart from the spirit and scope of the invention, are deemed to be covered by the invention, which is limited only by the claims which follow.

The invention claimed is:

1. A D-ring handle for use with emergency vehicles, said D-ring handle comprising:

(a) a D-shaped ring member having a curved leg and a base, said D-shaped ring member having a unitary construction, said leg and said base are integrally attached to one another;

(b) at least one tab integrally connected to said base, with said base of said D-shaped ring member rotatably coupled to a substrate member, such that pressure on said at least one tab moves said D-shaped ring member outward;

(c) a foot member including a pair of opposed supports for being hingedly attached to said D-shaped ring member, said foot member configured for rotatably coupling to a substrate member to actuate a latch member;

(d) a block member, integrally attached to said base, said block member including a hole that passes through said block member; and, (e) said foot member includes said pair of opposed supports, which receive and hold a pin member, which passes through said block member and at least partially through each of said opposed supports to rotatably attach said D-shaped ring member to a substrate member.

2. The D-ring handle of claim 1, additionally comprising: a substrate member.

3. The D-ring handle of claim 1, wherein said base includes a top edge and said at least one tab is connected to said base at said top edge.

4. The D-ring handle of claim 3, wherein said at least one tab includes one tab.

5. A D-ring handle for use with emergency vehicles, said D-ring handle comprising:

(a) a D-shaped ring member having a curved leg and a base, said D-shaped ring member having a unitary construction, said leg and said base are integrally attached to one another, and said base includes at least two tube members;

(b) at least one tab integrally connected to said base, with said base of said D-shaped ring member rotatably coupled to a substrate member, such that pressure on said at least one tab moves said D-shaped ring member outward; and, (c) a foot member including a pair of opposed supports for being hingedly attached to said D-shaped ring member, said pair of opposed supports for receiving and holding a pin member, which passes through said tube members and at least partially through each of said opposed supports to rotatably attach said D-shaped ring member to a substrate member for actuating a latch member.

6. The D-ring handle of claim 5, additionally comprising: a substrate member.

7. A D-ring handle for use with emergency vehicles, said D-ring handle comprising:

(a) a D-shaped ring member having a curved leg and a base, said D-shaped ring member having a unitary construction, said leg and said base are integrally attached to one another;

(b) at least one tab integrally connected to said base, with said base of said D-shaped ring member rotatably coupled to a substrate member, such that pressure on said at least one tab moves said D-shaped ring member outward; and, (c) a foot member including a pair of opposed supports for being hingedly attached to said D-shaped ring member, said foot member configured for rotatably coupling to a substrate member to actuate a latch member, wherein said base includes a block member, integrally attached to said base, said block member includes a hole that passes through said block member, and said foot member includes said pair of opposed supports, which receive and hold a pin member, which passes through said block member and at least partially through each of said opposed supports to rotatably attach said D-shaped ring member to a substrate member.

8. The D-ring handle of claim 7, additionally comprising: a substrate member.

9. The D-ring handle of claim 7, wherein said base includes a top edge and said at least one tab is connected to said base at said top edge.

10. The D-ring handle of claim 9, wherein said at least one tab includes one tab.

11. A D-ring handle for use with emergency vehicles, said D-ring handle comprising:

(a) a D-shaped ring member having a curved leg and a base, said D-shaped ring member having a unitary construction, said leg and said base are integrally attached to one another;

(b) at least one tab integrally connected to said base, with said base of said D-shaped ring member rotatably coupled to a substrate member, such that pressure on said at least one tab moves said D-shaped ring member outward; and, (c) a foot member including a pair of opposed supports for being hingedly attached to said D-shaped ring member, said foot member configured for rotatably coupling to a substrate member to actuate a latch member, wherein said base includes at least two tube members and said foot member includes said pair of opposed supports, which receive and hold a pin member, which passes through said tube members and at least partially through each of said opposed supports to rotatably attach said D-shaped ring member to a substrate member.

12. The D-ring handle of claim 11, additionally comprising: a substrate member.

13. A D-ring handle for use with emergency vehicles, said D-ring handle comprising:

(a) a D-shaped ring member configured for being hingedly coupled to a faceplate, said D-shaped ring member having a curved leg and a base, said D-shaped ring member having a unitary construction, said leg and base being integrally attached to one another;

(b) at least one tab integrally connected to said base, said D-shaped ring member configured for being rotatably coupled to a faceplate, said at least one tab configured with respect to said base such that when pressure is applied thereto, said D-shaped ring member moves outward; and, (c) a foot member including a pair of opposed supports for receiving a portion of said base member at least substantially centrally along said base member, and configured for rotating relative to a faceplate for actuating a latch member.

14. The D-ring handle of claim 13, wherein said base includes a top edge and said at least one tab is connected to said base at said top edge.

15. The D-ring handle of claim 14, wherein said at least one tab includes one tab.

16. The D-ring handle of claim 13, additionally comprising: a faceplate.

* * * * *

UNITED STATES PATENT AND TRADEMARK OFFICE

CERTIFICATE OF CORRECTION

PATENT NO. : 7,124,475 B2
APPLICATION NO. : 10/063187
DATED : October 24, 2006
INVENTOR(S) : Mark Jeffries It is certified that error appears in the above-identified patent and that said Letters Patent is hereby corrected as shown below:

Column 4, Line 9 "aJ-shaped" should be
-- a J-shaped --

Column 4, Line 33 "Figs. 13-5" should be
-- Figs. 13-15 --

Signed and Sealed this

Nineteenth Day of December, 2006

JON W. DUDAS
*Director of the United States Patent and Trademark Office*